US009196208B2

(12) United States Patent
Dong et al.

(10) Patent No.: US 9,196,208 B2
(45) Date of Patent: Nov. 24, 2015

(54) GATE DRIVE METHOD IN WHICH A FLICKERING PHENOMEN IS ELIMINATED AND GATE DRIVE DEVICE OF LIQUID CRYSTAL DISPLAY

(75) Inventors: Yun Dong, Beijing (CN); Wei Qin, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 93 days.

(21) Appl. No.: 13/338,422

(22) Filed: Dec. 28, 2011

(65) Prior Publication Data

US 2012/0169706 A1 Jul. 5, 2012

(30) Foreign Application Priority Data

Dec. 31, 2010 (CN) ..... 2010 1 0620163

(51) Int. Cl.
*G09G 3/36* (2006.01)

(52) U.S. Cl.
CPC ..... *G09G 3/3677* (2013.01); *G09G 3/3611* (2013.01); *G09G 3/3685* (2013.01); *G09G 2320/0219* (2013.01); *G09G 2320/0247* (2013.01)

(58) Field of Classification Search
USPC ..... 345/87, 94, 100, 204
See application file for complete search history.

(56) References Cited

U.S. PATENT DOCUMENTS 6,067,064 A * 5/2000 Furuhashi et al. ..... 345/89
7,079,123 B2 * 7/2006 Shino et al. ..... 345/204
7,486,264 B2 * 2/2009 Taguchi ..... 345/87
7,924,255 B2 * 4/2011 Hsu et al. ..... 345/94
2004/0017344 A1 * 1/2004 Takemoto ..... 345/87
2004/0095342 A1 * 5/2004 Lee et al. ..... 345/211
2004/0189573 A1 * 9/2004 Lee et al. ..... 345/94
2004/0189584 A1 * 9/2004 Moon ..... 345/100
2005/0057481 A1 * 3/2005 Chung ..... 345/100

(Continued)

FOREIGN PATENT DOCUMENTS

CN 101354870 A 1/2009
CN 101551974 A 10/2009

(Continued)

OTHER PUBLICATIONS

Chinese First Office Action dated Feb. 6, 2013; Appln. 201010620163.1.
Chinese Rejection Decision dated Jul. 25, 2013; Appln. No. 201010620163.1.

(Continued)

*Primary Examiner* — Roy Rabindranath
(74) *Attorney, Agent, or Firm* — Ladas & Parry LLP

(57) ABSTRACT

The embodiments of the present disclosure discloses a gate drive method and a gate drive device of a liquid crystal display, which can avoid the influence by the voltage difference ΔVp between the pixel voltage and the data line voltage, and eliminate the flickering phenomenon and the residual image caused by the residual direct current effectively. The gate drive method of the liquid crystal display comprises: inputting a compensation voltage Vgc to the n-th row of gate line when the n-th row of gate line is turned off completely in the current frame; keep on inputting the compensation voltage Vgc; and stopping inputting the compensation voltage Vgc to the n-th row of gate line when a turn-on voltage Vgh is input to the n-th row of gate line in the next frame; wherein, N≤the total number of the gate lines.

6 Claims, 3 Drawing Sheets

(56) References Cited

U.S. PATENT DOCUMENTS

| | | | | |
|---|---|---|---|---|
| 2006/0176255 | A1* | 8/2006 | Do et al. | 345/87 |
| 2008/0074404 | A1* | 3/2008 | Sashida | 345/204 |
| 2008/0174588 | A1* | 7/2008 | Kim et al. | 345/211 |
| 2009/0225106 | A1* | 9/2009 | Kim et al. | 345/691 |
| 2009/0244049 | A1 | 10/2009 | Yamamoto et al. | |

FOREIGN PATENT DOCUMENTS

| | | | |
|---|---|---|---|
| CN | 101770750 | A | 7/2010 |
| JP | 2006-350335 | A | 12/2006 |
| KR | 10223347 | B1 | 7/1999 |
| KR | 20050027612 | A | 3/2005 |
| KR | 1020060062645 | A | 6/2006 |

OTHER PUBLICATIONS

Korean Office Action dated Jan. 29, 2014; Appln. No. 10-2011-0145686.

Korean Office Action dated Jul. 3, 2014, Appln. No. 10-2011-0145686.

Chinese Notice of Reexamination dated Sep. 12, 2014; Appln. No. 201010620163.1.

Chinese Notification of ReExamination dated May 13, 2014; Appln. No. 201010620163.1.

Chinese Notice of Reexamination dated Dec. 17, 2014; Appln. No. 201010620163.1.

Korean Notice of Allowance dated Jan. 28, 2015; Appln. No. 10-2011-0145686.

* cited by examiner

GATE DRIVE METHOD IN WHICH A FLICKERING PHENOMEN IS ELIMINATED AND GATE DRIVE DEVICE OF LIQUID CRYSTAL DISPLAY

BACKGROUND

Embodiments of the present disclosure relate to the field of liquid crystal display, and particularly to a gate drive method and a gate drive device of a liquid crystal display.

Recently, the liquid crystal display (LCD) related products have been developed rapidly. More and more LCDs with high quality gradually come into the market, and the application fields thereof are increasingly broadened.

The basic principle of displaying images by a LCD is as follows. Different voltages are applied between the two electrode plates of the liquid crystal to deflect the liquid crystal molecules by a certain angle, so that the light can pass through. The transmission ratio of the liquid crystal is determined by the deflection angle of the liquid crystal molecules. Thereby, a gradation display with different grayscales is generated.

Usually, in order to prevent the liquid crystal molecules from aging, a polarity reversion is used when images are displayed by the LCD. The polarity in the "polarity reversion" is referred to as a positive polarity when the pixel voltage is higher than the voltage of the common electrode signal, and referred to as a negative polarity when the pixel voltage is lower than the voltage of the common electrode signal. Due to factors such as parasitic capacitance, the actual pixel voltage of the pixel electrode is inconsistent with the data line voltage, and there is a voltage difference ΔVp. Due to the existence of ΔVp and the requirement for polarity reversion between the positive polarity and the negative polarity, the common electrode signal Vcom is required to be in the center between the positive polarity and the negative polarity.

Usually, at the development stage as well as the mass production stage, the common electrode signal Vcom is adjusted to be in the center between the positive polarity and the negative polarity of the actual pixel electrode, then applied to the product. In the prior art, generally, either ΔVp is reduced by reducing the parasitic capacitance, or the common electrode signal Vcom is adjusted by using a feedback loop. However, the inventor finds out that there are at least the following problems in the prior art. Firstly, in the method of reducing ΔVp by reducing the parasitic capacitance, due to restrictions on the charge and discharge requirements, ΔVp is reduced in a limited extent, and adjustment effect is unsatisfactory. Secondly, in the method of adjusting the common electrode signal Vcom by using the feedback loop, since a decision depending on the visual sense of the operator is needed, the adjusted common electrode signal Vcom may not be exact in the center between the positive polarity and the negative polarity of the actual pixel electrode. Therefore, the adjustment effects of the two methods are both unsatisfactory, and the two methods cannot resolve the flickering caused by the voltage difference ΔVp and the residual image caused by the residual direct current.

SUMMARY

Embodiments of the present disclosure provide a gate drive method and a gate drive device of a liquid crystal display, which can avoid the influence by the voltage difference ΔVp between the pixel voltage and the data line voltage, and eliminate the flickering phenomenon and the residual image caused by the residual direct current effectively.

To achieve the above object, the gate drive method and the gate drive device of the liquid crystal display in the present disclosure adopt the following technical solutions.

An embodiment provides a gate drive method of a liquid crystal display, which comprises: inputting a compensation voltage Vgc to the N-th row of gate line when the n-th row of gate line is turned off completely in the current frame; keeping on inputting the compensation voltage Vgc; and stopping inputting the compensation voltage Vgc to the n-th row of gate line when a turn-on voltage Vgh is input to the n-th row of gate line in the next frame; wherein, N≤the total number of the gate lines.

In an example, before the n-th row of gate line is completed turned off, the method further comprises: inputting the turn-on voltage Vgh to the n-th row of gate line to control the gate line to be turned on; and inputting a turn-off voltage Vgl to the n-th row of gate line to control the gate line to be turned off.

In an example, the pixel structure of the liquid crystal display is a structure in which the gate line is used as the lower electrode plate of a storage capacitor Cst, the capacitance of a thin film transistor is Cgs, and the compensation voltage Vgc=Vgh×Cgs/Cst.

In an example, the pixel structure of the liquid crystal display is a structure in which the gate line and a common electrode line are used as the lower electrode plate of a storage capacitor Cst, the capacitance of a thin film transistor is Cgs, and the compensation voltage Vgc=Vgh×Cgs/Cst.

Another embodiment provides a gate drive device of a liquid crystal display, which comprises: a compensation module connected to the gate line, which inputs a compensation voltage Vgc to the n-th row of gate line when the n-th row of gate line is turned off completely in the current frame; keeps on inputting the compensation voltage Vgc; and stops inputting the compensation voltage Vgc to the n-th row of gate line when a turn-on voltage Vgh is input to the n-th row of gate line in the next frame; wherein, N≤the total number of the gate lines.

In an example, the gate drive device of the liquid crystal display further comprises: a turn-on module, which inputs the turn-on voltage Vgh to the n-th row of gate line to control the gate line to be turned on; and a turn-off module, which inputs a turn-off voltage Vgl to the n-th row of gate line to control the gate line to be turned off.

In an example, the pixel structure of the liquid crystal display is a structure in which the gate line is used as the lower electrode plate of a storage capacitor Cst, the capacitance of a thin film transistor is Cgs, and the compensation voltage Vgc=Vgh×Cgs/Cst.

In an example, the pixel structure of the liquid crystal display is a structure in which the gate line and a common electrode line are used as the lower electrode plate of a storage capacitor Cst, the capacitance of a thin film transistor is Cgs, and the compensation voltage Vgc=Vgh×Cgs/Cst.

In the technical solutions according to the embodiments of the present disclosure, when each gate line is turned off completely, a constant compensation voltage Vgc is compensated for the gate line until the gate line is turned on in the next frame, thereby canceling out the voltage difference ΔVp between the pixel voltage of the pixel electrode and the voltage of the data line signal due to factors such as parasitic capacitance, avoiding the influence by the voltage difference ΔVp, and eliminating the flickering phenomenon caused by the voltage difference ΔVp and the residual image caused by the residual direct current effectively.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the following detailed description.

BRIEF DESCRIPTION OF THE DRAWINGS

In order to explain the technical solutions of the embodiments of the present disclosure or the prior art more clearly, a brief introduction will be given hereinafter to the figures necessary for the description of the embodiments. Obviously, the figures for the embodiments in the following description are only some embodiments of the present disclosure, and those of ordinary skill in the art can derive other figures from these figures without inventive labor, in which.

DETAILED DESCRIPTION

In the following, the technical solutions of the embodiments of the present disclosure will be described clearly and thoroughly with reference to the figures in the embodiments of the present disclosure. Obviously, the described embodiments are only a part of, but not all, embodiments of the present disclosure. All the other embodiments obtained based on the embodiments of the present disclosure without inventive labor by those of ordinary skill in the art shall fall within the protection scope of the present disclosure.

The embodiments of the present disclosure provide a gate drive method and a gate drive device of a liquid crystal display, which can avoid the influence of the voltage difference ΔVp between the pixel voltage and the data line voltage, and eliminate the flickering phenomenon and the residual image caused by the residual direct current effectively.

Figure 1:
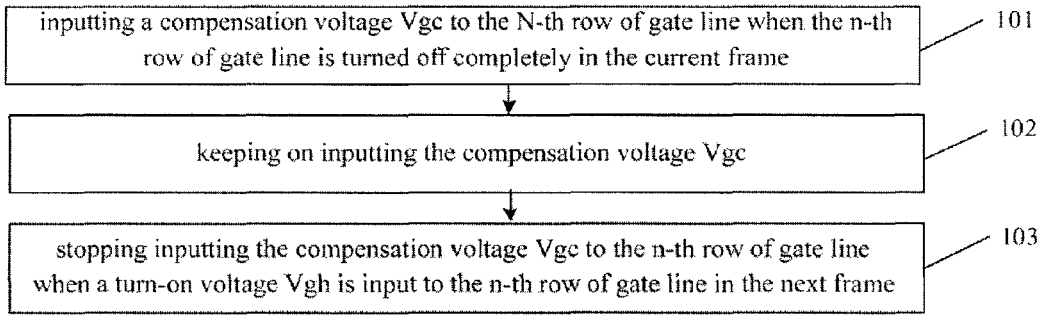
FIG. 1 is a first flowchart of a gate drive method of a liquid crystal display according to an embodiment of the present disclosure.

Due to factors such as parasitic capacitance, the actual pixel voltage of the pixel electrode is inconsistent with the data line voltage, and there is a voltage difference ΔVp. In order to avoid the influence of the voltage difference ΔVp and eliminate the flickering phenomenon and the residual image caused by the residual direct current effectively, a gate drive method of the liquid crystal display is provided in an embodiment of the present disclosure, which comprises the following steps as shown in FIG. 1.

At step 101, a compensation voltage Vgc is input to the n-th row of gate line when the n-th row of gate line is turned off completely in the current frame;

at step 102, the compensation voltage Vgc is kept on being input; and at step 103, the compensation voltage Vgc is stopped being input to the n-th row of gate line when a turn-on voltage Vgh is input to the n-th row of gate line in the next frame;

wherein, N≤the total number of the gate lines.

In the gate drive method of the liquid crystal display provided in the embodiment of the present disclosure, when each gate line is turned off completely, a constant compensation voltage Vgc is compensated for the gate line until the gate line is turned on in the next frame, thereby canceling out the voltage difference ΔVp between the pixel voltage of the pixel electrode and the voltage of the data line signal due to factors such as parasitic capacitance, avoiding the influence of the voltage difference ΔVp, and eliminating the flickering phenomenon caused by the voltage difference ΔVp and the residual image caused by the residual direct current effectively.

In the embodiment of the present disclosure, preferably, the technical solution of the present disclosure is described in detail by the following method.

Figure 2:
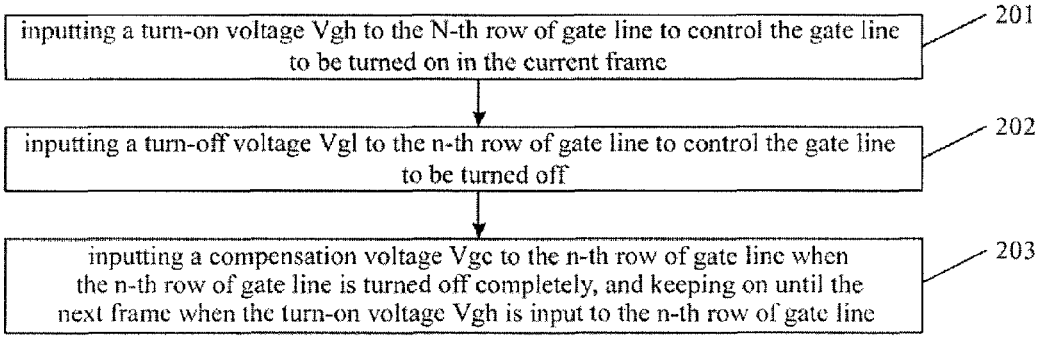
FIG. 2 is a second flowchart of the gate drive method of the liquid crystal display according to the embodiment of the present disclosure.

As shown in FIG. 2, the method comprises the following steps.

At step 201, the turn-on voltage Vgh is input to the n-th row of gate line to control the gate line to be turned on.

Figure 3:
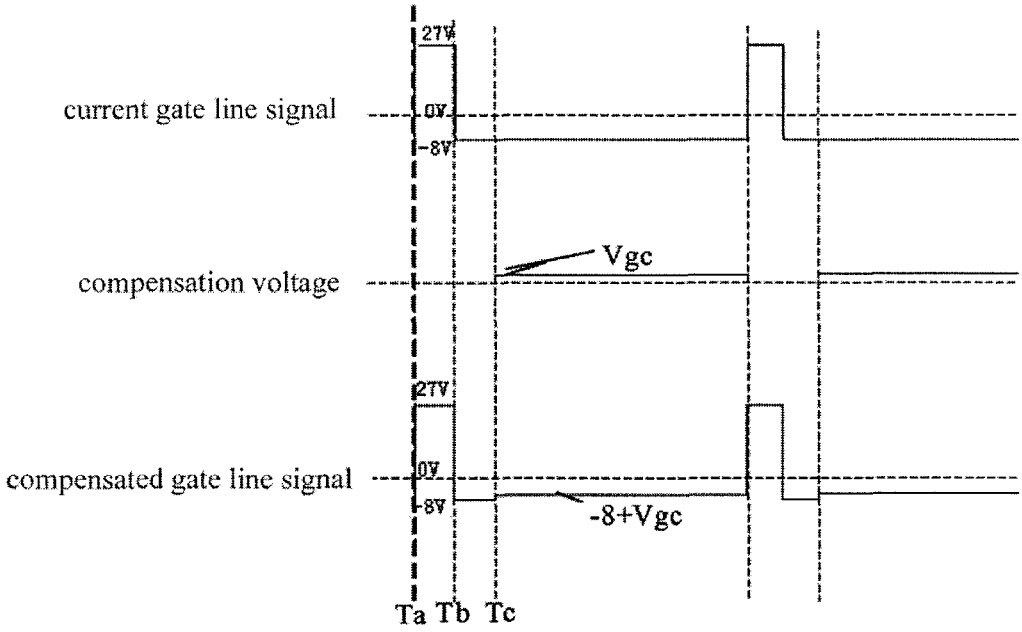
FIG. 3 is a schematic diagram for illustrating the principle of the gate drive method of the liquid crystal display according to the embodiment of the present disclosure.

In the image of each frame, the gate line is turned on row by row under the control of a gate drive device. For each row of gate line, the turn-on voltage Vgh needs to be input thereto by the gate drive device, so as to control the row of gate line to be turned on. After the gate line is turned on, image data is input to the pixel unit corresponding to the row of gate line. As shown in FIG. 3, the gate line is turned on at the timing Ta.

At step 202, a turn-off voltage Vgl is input to the n-th row of gate line to control the gate line to be turned off.

As shown in FIG. 3, the gate line starts to turn off at the timing Tb.

At step 203, when the n-th row of gate line is turned off completely, the compensation voltage Vgc is input to the n-th row of gate line until the next frame when the turn-on voltage Vgh is input to the n-th row of gate line.

As shown in FIG. 3, the gate line is turned off completely at the timing Tc. At this time, the compensation voltage Vgc is input to the gate line, and continues until the next frame when the turn-on voltage Vgh is input to the gate line.

It is to be noted that there are many ways to obtain the compensation voltage Vgc. Preferably, it is designed to generate the compensation voltage Vgc in a chip at the time point when the gate line is controlled to switch from on to off by a timing control signal, and to continue until the time point when the row of gate line is turned on in the next frame.

Figure 4:
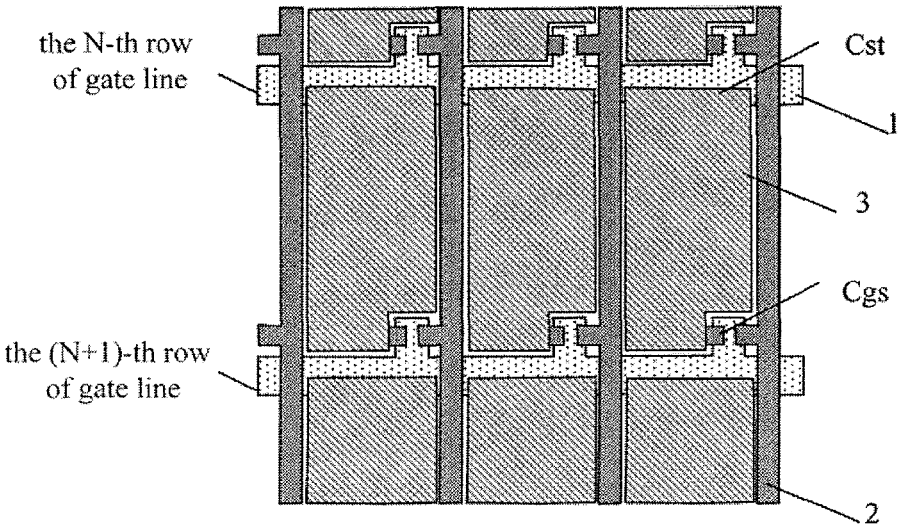
FIG. 4 is a structural schematic diagram of the pixel of the liquid crystal display according to the embodiment of the present disclosure.

In the following, a case will be described as an example where the pixel structure of the liquid crystal display is a structure in which a storage capacitor is formed on the gate line (Cst on Gate), i.e., a structure in which the gate line is used as the lower electrode plate of a storage capacitor Cst. As shown in FIG. 4, the pixels of the liquid crystal display are formed by multiple pixel units 3 at the intersection of the gate lines 1 and the data lines 2, wherein Cgs is the capacitance of a thin film transistor (TFT) and Cst is the storage capacitance. Then, the value of the compensation voltage is Vgc=Vgh×Cgs/Cst.

The detailed principle and implementation are as follows.

Figure 5:
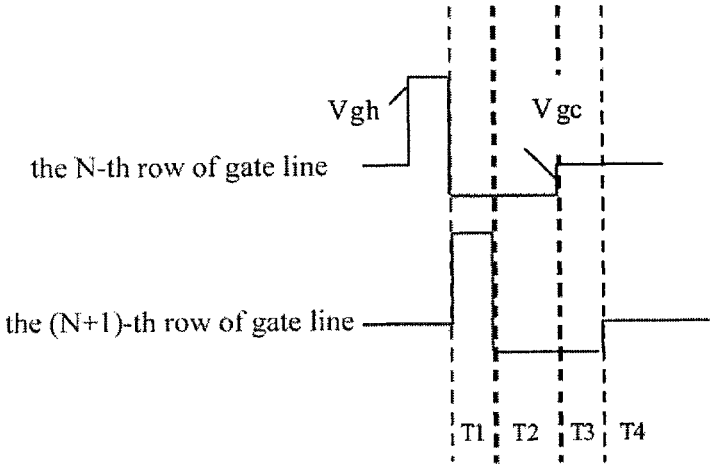
FIG. 5 is a schematic diagram for illustrating the principle of obtaining a compensation voltage in the gate drive method of the liquid crystal display according to the embodiment of the present disclosure.

FIG. 5 is a schematic diagram of a gate line signal on the n-th row of gate line and the (N+1)-th row of gate line.)

As shown in FIG. 5, during the time period T1, the pixel TFTs on the $(n+1)^{th}$ row of gate line are turned on, so that the coupling voltage on the pixel TFTs before the pixel TFTs are turned on is reset by a voltage written by the data line. At this time, the pixel voltage is equal to the data line voltage.

During the time period T2, the change in the voltage of the gate line signal of the pixel itself corresponding to the (n+1)-th row of gate line is −(Vgh+Vgc), which results in a pixel voltage change ΔV1 through the TFT capacitance Cgs:

$$\Delta V1=-(Vgh+Vgc)\times Cgs/(Cst+Cgs+Clc),$$

wherein, Clc is the pixel capacitance.

During the time period T3, the change in the voltage of the n-th row of gate line is +Vgc, which results in a pixel voltage change ΔV2 of the pixel corresponding to the (n+1)-th row of gate line through the storage capacitance Cst:

$$\Delta V2=Vgc\times Cst/(Cst+Cgs+Clc)$$

During the time period T4, the change in the voltage of the gate line signal of the pixel itself corresponding to the (n+1)-th row of gate line is +Vgc, which results in a pixel voltage change ΔV3 through the TFT capacitance Cgs:

$$\Delta V3=Vgc\times Cgs/(Cst+Cgs+Clc)$$

Therefore, after the time period T4, the pixel voltage Vpixel is:

$$V\text{pixel}=V\text{data}-\Delta V1+\Delta V2+\Delta V3$$

In the above formula, as long as (−ΔV1+ΔV2+ΔV3) is zero, the pixel voltage Vpixel written when the TFT is turned on is equal to Vdata. The pixel voltage Vpixel returns to the data line voltage Vdata after a series of capacitance coupling effects during the time periods T1, T2, T3 and T4. Substituting the above three formulas therein, it follows that the design requirement for the capacitance coupling change being zero is:

$$Vgc\times Cst=Vgh\times Cgs.$$

Then, by adjusting the compensation voltage Vgc only, the influence by the voltage change due to the capacitance coupling can be avoided, and the capacitance coupling effect of the gate line can be compensated completely. Thereby, the voltage difference ΔVp between the pixel voltage of the pixel electrode and the voltage of the data line signal due to factors such as parasitic capacitance is cancelled out, so that the influence by the voltage difference ΔVp is avoided, and the flicking phenomenon caused by the voltage difference ΔVp and the residual image caused by the residual direct current are eliminated effectively.

It is to be noted that, the above mentioned method also applies in a liquid crystal display with a pixel structure in which a storage capacitor is formed on the gate line and the common electrode line (Cst on Gate+common), i.e., the value of the compensation voltage is Vgc=Vgh×Cgs/Cst. Similarly, by adjusting the compensation voltage Vgc, the influence by the voltage variance caused by the capacitance coupling can be avoided, and the capacitance coupling effect of the gate line can be compensated for completely. It will not be described here to avoid redundancy.

Figure 6:
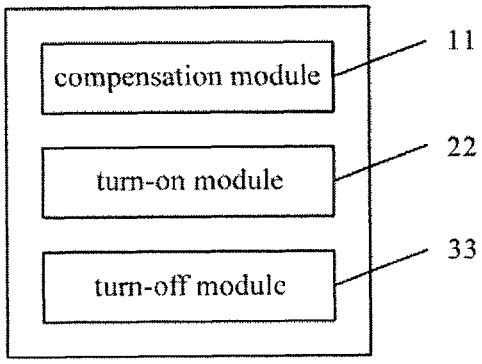
FIG. 6 is a structural schematic diagram of a gate drive device of the liquid crystal display according to the embodiment of the present disclosure.

The embodiment of the present disclosure also provide a gate drive device applied to the gate drive method of the liquid crystal display. As shown in FIG. 6, the device comprises: a compensation module 11, which inputs a compensation voltage Vgc to the n-th row of gate line when the n-th row of gate line is turned off completely in the current frame; keeps on inputting the compensation voltage Vgc; and stops inputting the compensation voltage Vgc to the n-th row of gate line when a turn-on voltage Vgh is input to the n-th row of gate line in the next frame; wherein, N≤the total number of the gate lines. The compensation module 11 is connected to the gate line, and its function can be achieved by a timing controller.

Further, the gate drive device also comprises a turn-on module 22 and a turn-off module 33.

The turn-on module 22 inputs the turn-on voltage Vgh to the n-th row of gate line to control the gate line to be turned on. The turn-off module 33 inputs a turn-off voltage Vgl to the n-th row of gate line to control the gate line to be turned off.

Further, the pixel structure of the liquid crystal display is a structure in which the gate line is used as the lower electrode plate of a storage capacitor Cst, the capacitance of a thin film transistor is Cgs, and the compensation voltage Vgc=Vgh×Cgs/Cst. Optionally, the pixel structure of the liquid crystal display is a structure in which the gate line and a common electrode line are used as the lower electrode plate of the storage capacitor Cst, the capacitance of a thin film transistor is Cgs, and the compensation voltage Vgc=Vgh×Cgs/Cst.

The method using the gate drive device of the liquid crystal display of the present embodiment is the same as the gate drive method described in the above embodiment, and will not be described here to avoid redundancy.

In the technical solutions of the embodiments of the present disclosure, the compensation module compensates a constant compensation voltage Vgc for each gate line when the gate line is turned off completely, until the gate line is turned on in the next frame, thereby canceling out the voltage difference ΔVp between the pixel voltage of the pixel electrode and the voltage of the data line signal caused by factors such as parasitic capacitance, avoiding the influence by the voltage difference ΔVp and eliminating the flickering phenomenon and the residual image caused by the residual direct current effectively.

Through the description on the above implementations, those skilled in the art can appreciate that the present disclosure can be implemented by software in combination with the necessary hardware for general purpose. Of course, the present disclosure can be implemented by hardware as well, but in many cases, the former one is a preferred implementation. Based on such understanding, the essential technical solutions of the present disclosure as a whole, or a part thereof that contribute to the disclosure over the prior art, can be embodied in a form of software product, which can be stored in a readable storage medium such as a soft disk, a hard disk or an optical disk of a computer etc., and comprises instructions that enables a computer device (which may be a personal computer, a server, or a network device, etc.) to execute the method described in the various embodiments of the present disclosure.

The above are only detailed embodiments of the present disclosure. Nevertheless, the protection scope of the present disclosure is not limited thereto. Those skilled in the art can think of variations or alternations easily within the technical scope disclosed by the present disclosure, and such variations or alternations shall be within the protection scope of the present disclosure. Therefore, the protection scope of the present disclosure shall be defined by the claims only.

What is claimed is:

1. A gate drive method of a liquid crystal display, comprising:

inputting a turn-on voltage Vgh to a n-th row of gate line to control the gate line to be turned on;

inputting a turn-off voltage Vgl to the n-th row of gate line to control the gate line to be turned off until a timing at which the n-th row of gate line is turned off completely;

adding a compensation voltage Vgc to the turn-off voltage Vgl and inputting the added voltage Vgc+Vgl to the n-th row of gate line when the n-th row of gate line is turned off completely in a current frame;

keep on inputting the added voltage Vgc+Vgl to cancel out a voltage difference between a pixel voltage of a pixel electrode and a voltage of a data line signal so as to eliminate a flickering phenomenon caused by the voltage difference; and stopping inputting the added voltage Vgc+Vgl to the n-th row of gate line when the turn-on voltage Vgh is input to the n-th row of gate line in a next frame, wherein, n is a positive integer and n≤the total number of the gate lines;

the compensation voltage is Vgc=Vgh×Cgs/Cst, Cgs representing a capacitance of a thin film transistor, and Cst representing a capacitance of a storage capacitor.

2. The gate drive method of the liquid crystal display according to claim 1, wherein, a pixel structure of the liquid crystal display is a structure in which the gate line is used as a lower electrode plate of the storage capacitor Cst.

3. The gate drive method of the liquid crystal display according to claim 1, wherein, a pixel structure of the liquid crystal display is a structure in which the gate line and a common electrode line are used as a lower electrode plate of the storage capacitor Cst.

4. A gate drive device of a liquid crystal display, comprising:

a turn-on module, which inputs a turn-on voltage Vgh to a n-th row of gate line to control the gate line to be turned on;

a turn-off module, which inputs a turn-off voltage Vgl to the n-th row of gate line to control the gate line to be turned off until a timing at which the n-th row of gate line is turned off completely;

a compensation module connected to the gate line, which adds a compensation voltage Vgc to the turn-off voltage Vgl and inputs the added voltage Vgc+Vgl to the n-th row of gate line when the n-th row of gate line is turned off completely in a current frame; keeps on inputting the added voltage Vgc+Vgl to cancel out a voltage difference between a pixel voltage of a pixel electrode and a voltage of a data line signal so as to eliminate a flickering phenomenon caused by the voltage difference; and stops inputting the added voltage Vgc+Vgl to the n-th row of gate line when the turn-on voltage Vgh is input to the n-th row of gate line in a next frame, wherein, n is a positive integer and n≤the total number of the gate lines;

the compensation voltage is Vgc=Vgh×Cgs/Cst, Cgs representing a capacitance of a thin film transistor, and Cst representing a capacitance of a storage capacitor.

5. The gate drive device of the liquid crystal display according to claim 4, wherein, a pixel structure of the liquid crystal display is a structure in which the gate line is used as a lower electrode plate of the storage capacitor Cst.

6. The gate drive device of the liquid crystal display according to claim 4, wherein, a pixel structure of the liquid crystal display is a structure in which the gate line and a common electrode line are used as a lower electrode plate of the storage capacitor Cst.

* * * * *